US006301727B1

(12) United States Patent
Bertrand et al.

(10) Patent No.: US 6,301,727 B1
(45) Date of Patent: Oct. 16, 2001

(54) MODULAR TUB SPOUT ASSEMBLY

(75) Inventors: John E. Bertrand, Avon; David J. Kruszewski, Parma, both of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/546,372

(22) Filed: Apr. 10, 2000

(51) Int. Cl.[7] ..... E03C 1/04

(52) U.S. Cl. ..... 4/678; 4/675; 4/567; 233/282; 137/359; 137/801; 285/8

(58) Field of Search ..... 4/675, 678, 615, 4/567, 568; 235/282, 283, 273, 600; 137/359, 360, 801; 285/8, 46, 90

(56) References Cited

U.S. PATENT DOCUMENTS 2,997,058 * 8/1961 Hall ..... 137/360
3,640,305 * 2/1972 Young ..... 137/360
4,884,596 * 12/1989 Byers et al. ..... 137/801
4,886,210 * 12/1989 Gaffney et al. ..... 239/193
5,165,121 * 11/1992 McTargette et al. ..... 4/678

FOREIGN PATENT DOCUMENTS

3205205-A1 * 3/1983 (DE) .

* cited by examiner

*Primary Examiner*—David J. Walczak
*Assistant Examiner*—Huyen Le
(74) *Attorney, Agent, or Firm*—Cook, Alex, McFarron, Manzo, Cummings & Mehler, Ltd.

(57) ABSTRACT

A modular tub spout assembly for use in removably attaching a tub spout on a threadless water pipe extending outwardly from a bath wall without affecting connection of the pipe to a water supply system behind the bath wall includes a tub spout insert, a sleeve and a seal member. The insert has an interior passage, at least a portion of which is of a size to provide a close, but sliding, fit on the pipe. The sleeve has an internal diameter providing a close, but sliding, fit on the pipe and there is a chamber in the insert formed and adapted to closely fit about the sleeve exterior. The seal member is also positioned within the chamber in the insert. A fastener extends within the aligned openings in the insert and sleeve to fix the insert on the pipe. There is a tub spout shell extending over and enclosing the insert and a fastener to attach the shell to the insert.

5 Claims, 1 Drawing Sheet

Fig.1.
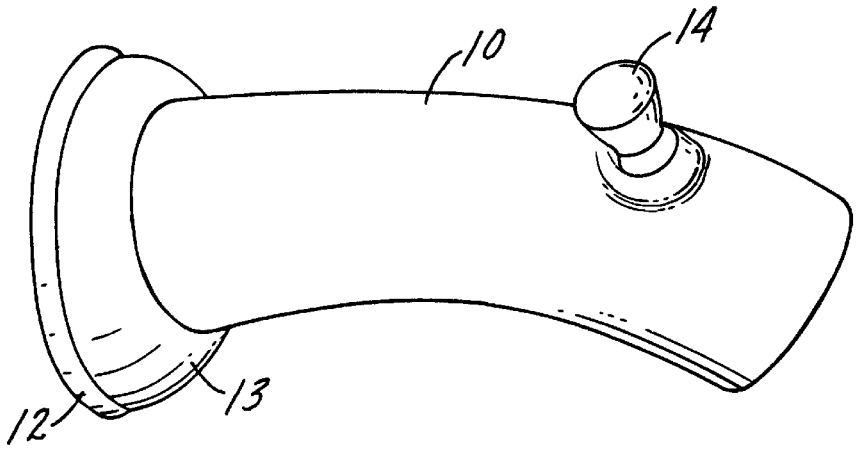
Fig.2.
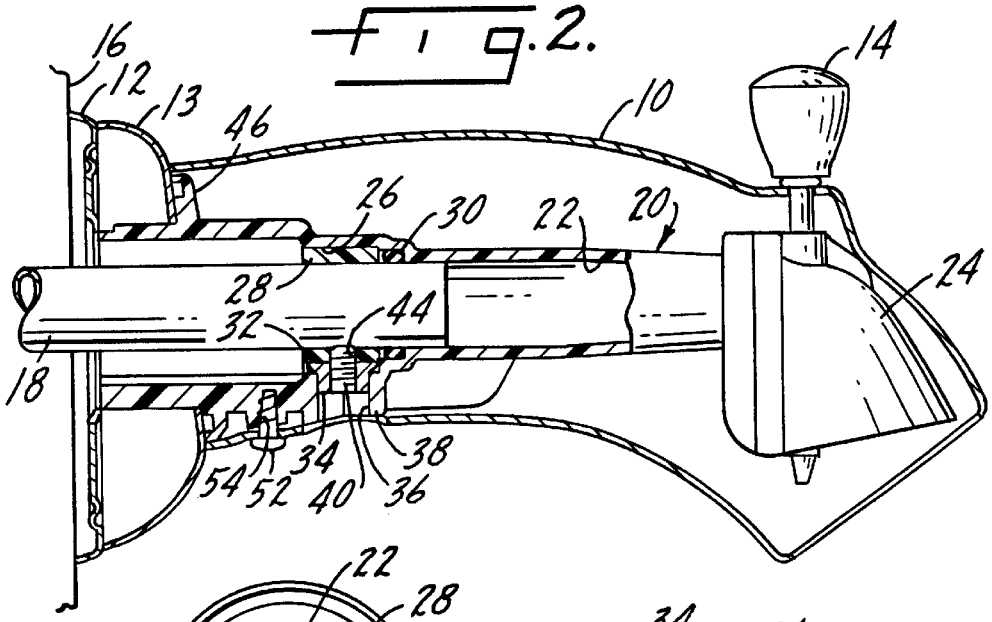
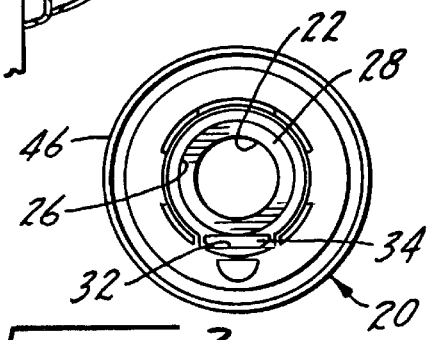
Fig.3.
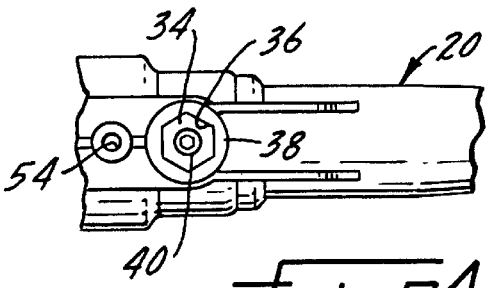
Fig.4.

MODULAR TUB SPOUT ASSEMBLY

THE FIELD OF TIE INVENTION

The present invention relates to a modular tub spout assembly in which the visible and functional elements of a tub spout may be removed without affecting or disturbing the connection between the pipe which extends through the bath wall and the water supply. It is conventional in bath installations for there to be a pipe which connects to the water supply and extends outwardly through the bath wall. The pipe is often threaded and a tub spout is threaded onto the pipe. Most homeowners are reluctant to remove an existing tub spout because of fear that in so doing they would break the connection between the pipe and the interior water supply connection which is behind the bath wall.

The present invention provides a mounting fixture for a tub spout assembly in which the decorative and functional elements of the tub spout, including the outer decorative shell as well as the insert or body which supports the shell, may be removed and replaced with elements having a different exterior appearance without affecting the behind-the-wall connection with the water supply. There is a pipe which extends outwardly through the bath wall from the water supply and this pipe may have a smooth, unthreaded end. A tub spout insert is combined with the tub spout shell and then mounted to the pipe through the use of a sleeve and a fastener which extends through aligned openings in the sleeve and the tub spout insert. Normally, this fastener will be placed at a bottom portion of the tub spout so as to be normally not visible to a user of the bath. The fastener attaches the insert and the sleeve on the unthreaded end of the pipe. Conventionally, the shell will include a diverter, with the diverter functioning in cooperation with the tub spout insert.

The entire tub spout assembly may be removed and replaced with one of a different esthetic and exterior decorative appearance without in any way affecting the connection between the water pipe which extends outwardly from the bath wall and the water supply connections behind the bath wall.

SUMMARY OF THE INVENTION

The present invention relates to a modular tub spout assembly and more specifically to such an assembly in which the decorative appearance of the spout may be changed and the functional elements replaced without affecting the connection between the water supply and the pipe which extends outwardly through the bath wall.

Another purpose is to provide a reliable, simply constructed and easily attached tub spout assembly which provides for removal and replacement of the decorative elements of the assembly without removing or affecting the water conduit that extends outwardly from the bath wall.

Another purpose of the invention is to provide a tub spout assembly which may be easily removed by the homeowner and replaced by such an assembly of different decorative appearance with the use of only simple hand tools.

Other purposes will appear in the ensuing specification, drawings and claims.

BRIEF DESCRIPTION OF THE DRAWINGS

The invention is illustrated diagrammatically in the following drawings wherein:

FIG. 1 is a perspective illustrating the exterior of the tub spout assembly;

FIG. 2 is a vertical section through the tub spout assembly;

FIG. 3 is a rear end view of the tub spout insert; and

FIG. 4 is a partial bottom view of the insert illustrating the attachment elements for the insert.

DESCRIPTION OF THE PREFERRED EMBODIMENT

The present invention relates to a mounting system for a modular tub spout assembly and more specifically it pertains to a mounting system in which the tub spout assembly may be simply removed and replaced by one of similar construction, but different decorative appearance, by the homeowner through the use of simple hand tools. Such a change in the tub spout may be done without affecting the water supply pipe connection which is normally located behind the bath wall.

Most homeowners are reluctant to remove an existing tub spout, as this usually dictates that the connecting pipe must be unscrewed from a fitting behind the tub or bath wall. Homeowners usually prefer that this function be performed by a licensed plumber. The present invention provides a mounting system in which the tub spout may be replaced without in any way altering or removing the water supply pipe which protrudes through the bath wall and is connected to the water supply system behind the wall. The components of the mounting system are all positioned on the water supply pipe in a manner in which they may be simply and easily removed with normal hand tools. The components which provide the connection between the tub spout and the pipe are normally hidden from view, with the exception of two fasteners which are on the underneath side of the tub spout and therefore normally not visible to someone using this plumbing fixture.

FIG. 1 illustrates the exterior of the tub spout assembly which includes a tub spout shell 10, an escutcheon 12, a decorative accent 13, and a diverter control knob 14.

Focusing on FIG. 2, the bath wall is indicated at 16 and a stub-out or copper pipe 18 extends outwardly from the wall. The pipe 18 is unthreaded. A tub spout insert is indicated generally at 20 and may be formed of various materials. Plastic is suitable, as is zinc formed by several manufacturing processes. Normally, the shell 10 will have an exterior decorative appearance which is suitable and compatible with other fixtures and accessories in the bath.

The insert 20 has an interior passage 22 which will convey water from the pipe 18 toward the diverter indicated generally at 24. The diverter is not illustrated in detail, but may be similar to or the same as that shown in U.S. Pat. No. Re. 28,610, owned by Moen Incorporated, the assignee of the present application.

The passage 22 is sized and has an inner diameter so as to closely fit over the exterior of the pipe 18, but yet be slidable on the pipe. The insert 20 has a chamber 26 sized to closely fit about a sleeve 28. The sleeve may be formed of a suitable plastic and fits within the chamber 26, as does a seal ring 30 which bears against the exterior of the pipe 18 and seals against the passage 22 of the insert 20.

The interior of the insert 20, adjacent the chamber 26, has a slot 32, illustrated in FIG. 3, which is used to guide a flanged nut 34 into the interior of the insert and allow that nut to be positioned within a recess 36 in a boss 38 which forms a part of the insert 20. The flanged nut 34 will sit in the recess which has the same hex-shaped interior as the exterior of the nut 34 such that the nut cannot rotate when a set screw 40 is turned down to attach the insert to the pipe 18. Specifically, the set screw 40 will be threaded into the flanged nut 34, extend through an opening 44 in the sleeve 28, and then be turned to bite into the exterior of pipe 18.

The insert 20 has an outwardly-extending flange 46 which will support the shell 10, as clearly shown in FIG. 2. The rear side of flange 46 will abut the spout accent 13, which in turn fits against the escutcheon 12.

The tub spout shell 10 is attached to the insert 20 through the use of a fastener 52 which extends through an opening in the bottom of the shell and into an aligned opening 54 at the bottom of the insert. Thus, both the fastener for attaching the shell and the set screw for attaching the insert to the pipe are on the underneath side of the tub spout assembly where they are normally not visible by the user of the tub spout.

In mounting the tub spout assembly shown herein, the first step is to slide the flanged nut 36 into its recess 34 at boss 38. Next, seal ring 30 is slid into the chamber 26 in the insert 20. The sleeve 28 is passed into the open end of the insert 20 until it resides in the chamber 26 and the sleeve opening 44 is in alignment with the boss 38 and its opening 42 so that the set screw may be used to attach all of these elements onto the pipe 18. Prior to attaching the spout functional elements onto the pipe, the tub spout accent and the escutcheon will be fastened to the insert by the use of screws or the like. At this point, and prior to actually mounting the insert on the pipe, it is necessary that the diverter elements be positioned within the diverter 24 of the insert 20. The shell 10 may then be attached to insert 20 by use of fastener 52. The diverter handle 14 and its associated rod will be passed through an opening in the shell to connect with the diverter elements as described in the above-referenced patent. The combined shell and insert are then mounted onto pipe 18 and attached thereto by set screw 40.

Of importance is the fact that the tub spout assembly may be easily removed by the homeowner without in any way affecting the water pipe connections. The set screw 40 may be backed off from its attachment to the pipe 18, which will allow the entire tub spout assembly to be removed from the pipe 18. The entire assembly may be replaced with one of similar function, but different decorative appearance, and this may be done with only backing off a single set screw.

Whereas the preferred form of the invention has been shown and described herein, it should be realized that there may be many modifications, substitutions and alterations thereto.

The embodiments of the invention in which an exclusive property or privilege is claimed are defined as follows:

1. A modular tub spout assembly for use in removably attaching a tub spout on a threadless water pipe extending outwardly from a bath wall without affecting connections of the pipe to a water supply system behind the bath wall, said assembly including:

a tub spout insert having an interior passage, at least a portion of which is of a size to provide a close, but sliding, fit on said pipe, a sleeve having an internal diameter providing a close, but sliding, fit on said pipe, a chamber in said tub spout insert sized to fit closely about the sleeve exterior diameter and to locate the sleeve positively relative to the tub spout insert, a seal member within said interior passage and in sealing contact with said tub spout insert and pipe, a fastener extending within aligned openings in said tub spout insert and sleeve to fix said insert on said pipe, said tub spout insert opening including a recess, a flange nut in said recess cooperating with said fastener, and a tub spout shell extending over and enclosing said insert, and means for fastening said shell to said insert.

2. The modular tub spout assembly of claim 1 wherein said seal ring is positioned within said insert chamber adjacent said sleeve.

3. The modular tub spout assembly of claim 1 wherein the means for fastening said shell to said insert include a fastener extending from a bottom portion of said shell into a bottom portion of said insert.

4. The modular tub spout assembly of claim 1 wherein said insert passage includes a groove for guiding said flanged nut toward said recess.

5. The modular tub spout assembly of claim 1 wherein said flanged nut has a polygonal exterior and said recess has a matching interior.

* * * * *